US005246482A

United States Patent [19]

Murakami et al.

[11] Patent Number: 5,246,482

[45] Date of Patent: Sep. 21, 1993

[54] MOLTEN METAL PRODUCING AND REFINING METHOD

[75] Inventors: Keikichi Murakami, Kobe; Mitsuharu Kishimoto, Harima; Yoshio Uchiyama, Akashi; Kenichi Yajima; Masaru Takiura, both of Kobe; Satoshi Tatsuta; Yukihiko Koza, both of Kobe; Sumio Satoh, Kobe, all of Japan

[73] Assignee: Kawasaki Jukogyo Kabushiki Kaisha, Kobe, Japan

[21] Appl. No.: 765,142

[22] Filed: Sep. 25, 1991

[30] Foreign Application Priority Data

Jun. 29, 1990 [JP] Japan ..... 2-172874

[51] Int. Cl.[5] ..... C21C 5/34

[52] U.S. Cl. ..... 75/378; 75/386; 75/387; 75/501; 75/707

[58] Field of Search ..... 75/532, 378, 386, 387, 75/556, 501, 707

[56] References Cited

U.S. PATENT DOCUMENTS

| | | | |
|---|---|---|---|
| 4,740,242 | 4/1988 | Nakamura et al. | 75/556 |
| 4,919,714 | 4/1990 | Sugiura et al. | 75/532 |
| 4,940,488 | 7/1990 | Maeda et al. . | |

FOREIGN PATENT DOCUMENTS

| | | |
|---|---|---|
| 0318896 | 6/1989 | European Pat. Off. . |
| 0355163 | 2/1990 | European Pat. Off. . |
| 61-221322 | 10/1986 | Japan . |
| 62-280311 | 12/1987 | Japan . |
| 64-68415 | 3/1989 | Japan . |
| 1-205016 | 8/1989 | Japan . |
| 155177 | 4/1991 | Taiwan . |

OTHER PUBLICATIONS

ASM International Handbook Committee-Author: D. M. Stefanescu et al. Title: *Metals Handbook Ninth Edition* vol. 15 Casting pp. 389-390, 1988.

Patent Abstracts of Japan vol. 11, No. 63 (C-406) (2510) 26 Feb. 1987 & JP-A-61 221 322 (Kawasaki Heavy Ind.) Oct. 1, 1986.

Patent Abstracts of Japan vol. 12, No. 172 (C-497) (3019) 21 May 1988 & JP-A-62 280 311 (Nippon Kokan) Dec. 5, 1987.

Patent Abstracts of Japan vol. 13, No. 510 (C-654) (3858) 15 Nov. 1989 & JP-A-1 205 016 (NKK Corp.) Aug. 17, 1989.

*Primary Examiner*—Melvyn J. Andrews

*Attorney, Agent, or Firm*—Marshall, O'Toole, Gerstein, Murray & Borun

[57] ABSTRACT

The disclosure relates to a molten metal producing and refining method which does not damage the apparatus, realizes a stable and high second combustion rate, and is capable of effectively recovering heat generated by the second combustion. The method comprises introducing a metal-containing material, a carbonaceous material, a flux and $O_2$ gas into a furnace. The carbon which dissolves into the metal bath in the furnace from the carbonaceous material is combusted with the $O_2$ gas to generate heat and CO gas. The CO gas is subjected to the second combustion with the $O_2$ gas to additionally generate heat, and the metal-containing material is melted and refined by both the generated heat and carbon. The method is characterized in that $O_2$ gas or $O_2$-containing gas is blown into the furnace through large-diameter tuyeres installed near the bottom of the furnace and a part of the $O_2$ gas does not combust in the metal bath and leaves the metal bath unburnt, to perform the second combustion of the unburnt $O_2$ gas with CO gas in the slag bath in the furnace.

17 Claims, 9 Drawing Sheets

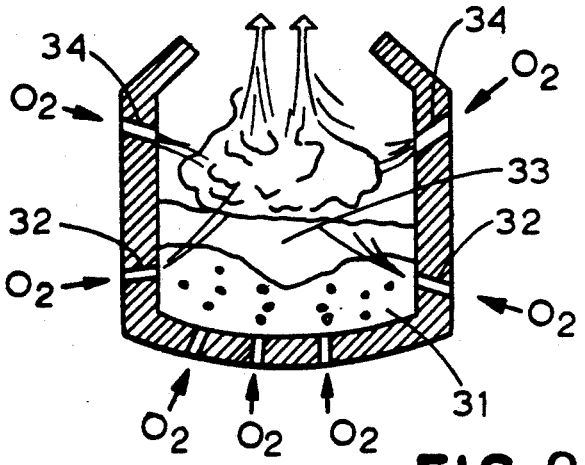
FIG. 8 PRIOR ART
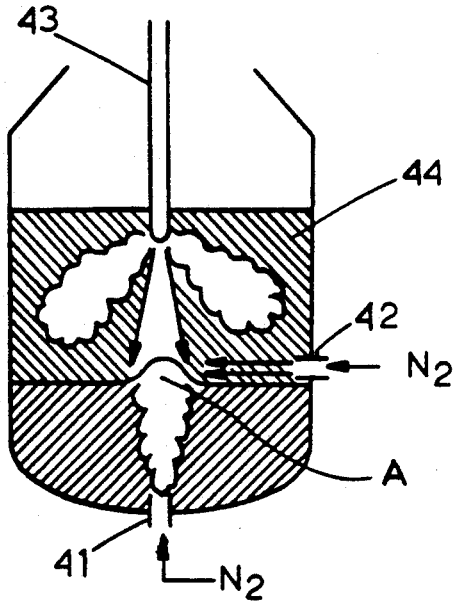
FIG. 9 PRIOR ART
FIG. 10 PRIOR ART
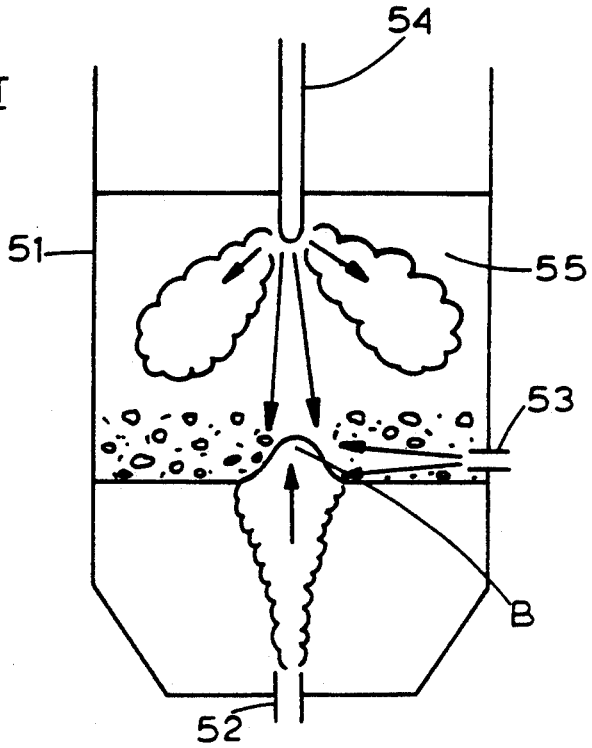

MOLTEN METAL PRODUCING AND REFINING METHOD

FIELD AND BACKGROUND OF THE INVENTION

The present invention relates to a method for producing and refining molten metal by introducing the metal-containing material, carbonaceous material, flux and $O_2$ gas into the molten metal.

The present invention is particularly applied to the following two refining methods. The first application is the smelting reduction method. The smelting reduction method will replace the blast furnace method which has been the primary method of producing iron for at least four hundred years. The blast furnace method has some disadvantages: It requires many appurtenant facilities such as coke oven plant and sinter plant, an expensive material such as coking coal and high quality ore, a high construction cost and a large space. Hence the smelting reduction method was developed recently as a technique which is free of such disadvantages.

The facility of the typical smelting reduction process mainly comprises a smelting reduction furnace and a prereduction furnace. The outline of the smelting reduction process is as follows:

In the prereduction furnace the metal oxide ore is pre-heated and prereduced by the gas discharged from the smelting reduction furnace. After that, the prereduced metal oxide ore is charged into the smelting reduction furnace together with a carbonaceous material such as coal and flux. $O_2$ gas and a stirring gas are introduced into the smelting reduction furnace, and the carbonaceous material will be dissolved into the molten metal generated in advance in the smelting reduction furnace. At the same time, the carbon in the carbonaceous material will be combusted by the $O_2$ gas (hereinafter referred to as "main $O_2$ gas") to produce CO gas and heat. This heat of combustion will be utilized to melt and finally reduce the prereduced metal oxide ore with carbon and to produce molten metal. The CO gas will be subjected to the secondary combustion by $O_2$ gas being blown into the furnace from a system which is separate from that of the main $CO_2$ gas (hereinafter referred to as "secondary combustion $O_2$ gas"). The heat generated by this combustion is also recovered in the molten metal and used in melting and final reduction of the ore.

The second application is the metallic scrap melting method. Just like the above-mentioned smelting reduction method, this process uses the heat generated by the combustion of carbon in carbonaceous material with $O_2$ gas to melt scrap.

The most important task in the above-mentioned process is to most effectively recover the heat generated by the second combustion in the furnace. About 80% of the heat given to the furnace is carried out in the form of CO gas. To effectively utilize the enormous latent heat in the form of this CO gas, the second combustion method must be applied. The following methods are known as prior art techniques relating to this second combustion.

The Japanese Patent Provisional Publication No. S-62-280311 discloses an invention concerning a "smelting reduction method characterized in that metal in the metal bath 31 (see FIG. 8 herein) generated by smelting reduction is splashed by a gas injected into the furnace to carry the metal into the second combustion zone," as shown in FIG. 8. (Hereinafter referred to as the "prior art I.")

The Japanese Patent Provisional Publication No. S-64-68415 discloses an invention relating to a "method for producing molten stainless steel by smelting reduction characterized in that in a smelting reduction furnace having a bottom-blown tuyere 41, a side-blown tuyere 42 and a top-blown lance 43 (see FIG. 9 herein), Co gas or/and an inert gas is blown into the furnace together with Cr ore through the bottom-blown tuyere 41, CO or/and an inert gas is blown into the furnace through the side-blown tuyere 42 so that at least a part of the gas flow strikes against a molten metal swell (A) due to the bottom-blown gas, main $O_2$ gas is blown into the molten metal through the top-blown lance 43, and $O_2$ gas for second combustion is blown into the slag from the side of the top-blown lance 43 to melt and reduce Cr ore, and after that the specified decarbonization process is given" as shown in FIG. 9. (Hereinafter referred to as the "prior art II.")

The Japanese Patent Provisional Publication No. H-1-205016 discloses an invention relating to a "smelting reduction method and its apparatus, said method being characterized in that iron ore is charged together with coal and a flux into a smelting reduction furnace 51 (see FIG. 10 herein), an inert gas and CO or process gas are blown into the furnace through a bottom-blown tuyere 52 and a side-blown tuyere 53, main $O_2$ gas and second combustion $O_2$ gas are blown into the furnace through the top-blown lance 54, at least a part of the gas flow from the side-blown tuyere 53 strikes against the molten metal swell (B) due to the gases blown into the furnace through the bottom-blown tuyere 52, and powdery coal or steam is blown into the furnace to control the oxidation degree of the exhaust gas," as shown in FIG. 10. (Hereinafter referred to as the "prior art III.")

Furthermore, the Japanese Patent Provisional Publication No. S-61-221322 discloses an invention relating to a "smelting reduction method characterized in that a large amount of slag 61 (see FIG. 11 herein) is maintained over a metal bath 62, a part of combustible gas generated in the furnace is combusted with oxygen-containing gas and the generated heat is transferred to the slag 61, the slag 61 is stirred or circulated by gas to effectively transfer heat retained in the slag to the metal bath 62 or the metallic material (C)," as shown in FIG. 11. (Hereinafter referred to as the "prior art IV.")

The above-mentioned prior arts I–IV, however, have the following problems.

In the prior art I, the metal in the metal bath 31 is splashed off, by the $O_2$ gas from a tuyere for splash forming 32, into a second combustion zone above the slag 33. The second combustion is performed by $O_2$ gas injected from the second combustion tuyeres 34. In this case, since the second combustion is performed above the slag 33, most of the heat generated by the second combustion is carried away by the exhaust gas although a part of the heat of combustion is transferred to the metal. Thus the heat can not be effectively recovered by the metal. Moreover, as the heat of radiation of the second combustion significantly raises the temperature of the refractories, on the inner side wall of the furnace, the refractories will suffer a greater damage.

In the prior art II, the second combustion is performed in the slag 44 by the second combustion $O_2$ gas blown into the furnace through the top-blown lance 43. The feed rate of the second combustion $O_2$ gas blown into the furnace, however, is limited. Moreover, even if the slag is strongly stirred by the gas blown into the furnace through the side-blown tuyere 42, it is difficult to achieve the complete mixture and combustion of the second combustion $O_2$ gas and the gas to be combusted (CO gas). A fairly large amount of CO gas escapes from the molten metal through the slag layer without meeting the second combustion $O_2$ gas. Under such circumstances, if the feed rate of the second combustion $O_2$ gas is increased to improve the second combustion rate, a larger part of the $O_2$ gas will be left unreacted, and this unreacted $O_2$ gas will burn above the slag 44, and just as the case of the prior art I, the heat of combustion will be carried away by the waste gas and can not be utilized effectively. Moreover, the heat of radiation of the second combustion will give a greater damage to the refractories in the furnace.

In the prior art III, the second combustion is performed in the slag 55 by the second combustion $O_2$ gas blown into by the top-blown oxygen lance 54, and has disadvantages similar to those of the prior art II.

The prior art IV has an advantage that the second combustion is stably performed since the large quantity of slag bath 61 serves as the buffer in the chemical processes and/or as the heat insulating layer. This prior art IV, however, has disadvantages similar to those of the above-mentioned prior art II or III.

The present invention was made in view of the above-mentioned disadvantage of the prior art, and is intended to provide a molten metal producing and refining method which gives no damage to the apparatus, realizes a stable and high second combustion rate and effectively recover the heat generated by the second combustion.

SUMMARY OF THE INVENTION

To achieve the above-mentioned objective, the gist of the present invention comprises:

a first feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat and carbon, said method being characterized in that $O_2$ gas or $O_2$-containing gas is blown into the furnace through large-diameter tuyeres installed near the bottom of the furnace, and a part of the $O_2$ gas does not combust in the metal bath and leaves the metal bath unburnt, to perform the second combustion of the unburnt $O_2$ gas with CO gas in the slag;

a second feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a large-diameter tuyere near the bottom, the ratio $(CO_2/(CO+CO_2))$ of the gas at the upper part or at the outlet of the furnace can be adjusted by controlling the ratio of the $_2$ gas flow rate to the flow rate of the other gas, utilizing the relationship that when the ratio of $O_2$ gas flow rate to the flow rate of the other gas is reduced, the ratio $(CO_2/(CO+CO_2))$ of the gas at the upper part or at the outlet of the furnace is increased, and reversely, when the ratio of $O_2$ gas flow rate to the flow rate of the other gas is increased, the ratio $(CO_2/(CO+CO_2))$ of the gas is decreased;

a third feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, a double-layer gas flow comprising an inner $O_2$ gas flow of a large diameter and an outer flow of a gas other than $O_2$, such as $N_2$ gas or air, the latter surrounding the former, is blown into the furnace through tuyeres installed near the bottom of the furnace, the ratio $(CO_2/(CO+CO_2))$ of the gas at the upper part or at the outlet of the furnace can be adjusted by controlling the ratio of the $O_2$ gas flow rate to the flow rate of the different gas, utilizing the relationship that when the ratio of $O_2$ gas flow rate to the flow rate of the other gas is reduced, the ratio $(CO_2/(CO+CO_2))$ of the gas at the upper part or at the outlet of the furnace is increased, and reversely, when the ratio of the $O_2$ gas flow rate to the flow rate of the other gas is increased, the ratio $(CO_2/(CO+CO_2))$ of the gas is decreased;

a fourth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat and carbon, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a plurality of large-diameter tuyeres and a plurality of small-diameter tuyeres near the bottom of the furnace, the metal-containing material is melted and refined while the CO concentration and the $CO_2$ concentration in the upper part or at the outlet of the furnace are measured, and the ratio $(CO_2/(CO+CO_2))$ of the gas at the upper part or at the outlet of the furnace can be adjusted by controlling the above-mentioned $O_2$ gas flow rate and the gas flow rate of the different gas;

a fifth feature of the present invention comprising a molten metal producing and refining method of the above-mentioned first feature of this invention characterized in that the ratio ($CO_2/(CO+CO_2)$) of the gas at the upper part or at the outlet of the furnace can be adjusted by controlling the flow rate of the $O_2$ gas or $O_2$-containing gas blown into the furnace, utilizing the relationship that when the flow rate of the $O_2$ gas or $O_2$-containing gas blown into is reduced, the ratio ($CO_2/(CO+CO_2)$) in the upper part or at the outlet of the furnace is decreased, and reversely, when the flow rate of the $O_2$ gas or $O_2$-containing gas blown into is increased, the ratio ($CO_2/(CO+CO_2)$) of the gas is increased;

a sixth feature of the present invention comprising a molten metal producing and refining method of the above-mentioned first feature of this invention characterized in that the ratio ($CO_2/(CO+CO_2)$) of the gas at the upper part or at the outlet of the furnace can be adjusted by controlling the metal bath level in the furnace, utilizing the relationship that when the metal bath level in the furnace is lowered, the ratio ($CO_2/(CO+CO_2)$) of the gas at the upper part or at the outlet of the furnace is increased, and reversely, when the metal bath level) in the furnace is raised, the ratio ($CO_2/(CO+CO_2)$) of the gas is decreased;

a seventh feature of the present invention comprising a molten metal producing and refining method of the above-mentioned first feature of this invention characterized in that the ratio ($CO_2/(CO+CO_2)$) of the gas at the upper part or at the outlet of the furnace can be adjusted by controlling the pressure in the furnace, utilizing the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased;

an eighth feature of the present invention comprising a molten metal producing and refining method of the above-mentioned first feature of this invention characterized in that $O_2$ gas or $O_2$-containing gas is also blown into the furnace through tuyeres installed on the top or the side of the furnace.

a ninth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat and carbon, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a large-diameter tuyere near the bottom, the ratio ($CO_2/(CO+CO_2)$) of the gas at the upper part or at the outlet of the furnace can be adjusted by controlling the ratio of the $O_2$ gas flow rate to the flow rate of the other gas and the metal bath level in the furnace, utilizing the relationship that when the ratio of $O_2$ gas flow rate to the flow rate of the other gas is reduced, the ratio ($CO_2/(CO+CO_2)$) of the gas at the upper part or at the outlet of the furnace is increased, and reversely, when the ratio of $O_2$ gas flow rate to the flow rate of the other gas is increased, the ratio ($CO_2/(CO+CO_2)$) of the gas is decreased and the relationship that when the metal bath level in the furnace is lowered, the ratio ($CO_2/(CO+CO_2)$) of the gas at the upper part or at the outlet of the furnace is increased, and reversely, when the metal bath level in the furnace is raised, the ratio ($CO_2/(CO+CO_2)$) of the gas is decreased;

a tenth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, a double-layer gas flow comprising an inner $O_2$ gas flow of a large diameter and an outer flow of a gas other than $_2$, such as $N_2$ gas or air, the latter surrounding the former, is blown into the furnace through tuyeres installed near the bottom of the furnace, the ratio ($CO_2/(CO+CO_2)$) of the gas at the upper part or at the outlet of the furnace can be adjusted by controlling the ratio of the $O_2$ gas flow rate to the flow rate of the different gas and the metal bath level in the furnace, utilizing the relationship that when the ratio of $O_2$ gas flow rate to the flow rate of the other gas is reduced, the ratio ($CO_2/(CO+CO_2)$) of the gas at the upper part or at the outlet of the furnace is increased, and reversely, when the ratio of the $O_2$ gas flow rate to the flow rate of the other gas is increased, the ratio ($CO_2/(CO+CO_2)$) of the gas is decreased and the relationship that when the metal bath level in the furnace is lowered, the ratio ($CO_2/(CO+CO_2)$) of the gas at the upper part or at the outlet of the furnace is increased, and reversely, when the metal bath level in the furnace is raised, the ratio ($CO_2/(CO+CO_2)$) of the gas is decreased;

an eleventh feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat and carbon, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a plurality of large-diameter tuyeres and a plurality of small-diameter tuyeres installed near the bottom of the furnace, the metal-containing material is melted and refined while the CO concentration and the $CO_2$ concentration in the upper part or at the outlet of the furnace are measured, and the ratio ($CO_2/(CO+CO_2)$) of the gas at the upper part or at the outlet of the furnace can be adjusted by controlling the above-mentioned $O_2$ gas flow rate and the gas flow rate of the different gas and the metal bath level in the furnace, utilizing the relationship that when the metal bath level in the furnace is lowered, the ratio ($CO_2/(CO+CO_2)$) of the gas at the upper part or at the outlet of the furnace is increased, and reversely, when the metal bath level in the furnace is raised, the ratio ($CO_2/(CO+CO_2)$) of the gas is decreased;

a twelfth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a large-diameter tuyere near the bottom, the ratio ($CO_2/(CO+CO_2)$) of the gas at the upper part or at the outlet of the furnace can be adjusted by controlling the ratio of the $O_2$ gas flow rate to the flow rate of the other gas and the pressure in the furnace, utilizing the relationship that when the ratio of $O_2$ gas flow rate to the flow rate of the other gas is reduced, the ratio ($CO_2/(CO+CO_2)$) of the gas at the upper part or at the outlet of the furnace is increased, and reversely, when the ratio of $_2$ gas flow rate to the flow rate of the other gas is increased, the ratio ($CO_2/(CO+CO_2)$) of the gas is decreased, and the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased;

a thirteenth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, a double-layer gas flow comprising an inner $O_2$ gas flow of a large diameter and an outer flow of a gas other than $O_2$, such as $N_2$ gas or air, the latter surrounding the former, is blown into the furnace through tuyeres installed near the bottom of the furnace, the ratio ($CO_2/(CO+CO_2)$) of the gas at the upper part or at the outlet of the furnace can be adjusted by controlling the ratio of the $O_2$ gas flow rate to the flow rate of the different gas and the pressure in the furnace, utilizing the relationship that when the ratio of $O_2$ gas flow rate to the flow rate of the other gas is reduced, the ratio ($CO_2/(CO+CO_2)$) of the gas at the upper part or at the outlet of the furnace is increased, and reversely, when the ratio of the $O_2$ gas flow rate to the flow rate of the other gas is increased, the ratio ($CO_2/(CO+CO_2)$) of the gas is decreased, and the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased;

a fourteenth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat and carbon, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a plurality of large-diameter tuyeres and a plurality of small-diameter tuyeres installed near the bottom of the furnace, the metal-containing material is melted and refined while the CO concentration and the $CO_2$ concentration in the upper part or at the outlet of the furnace are measured, and the ratio ($CO_2/(CO+CO_2)$) of the gas at the upper part or at the outlet of the furnace can be adjusted by controlling the above-mentioned $O_2$ gas flow rate and the gas flow rate of the different gas and the pressure in the furnace, utilizing the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased;

a fifteenth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a large-diameter tuyere near the bottom, the ratio ($CO_2/(CO+CO_2)$) of the gas at the upper part or at the outlet of the furnace can be adjusted by controlling the ratio of the $O_2$ gas flow rate to the flow rate of the other gas and the metal bath level in the furnace and the pressure in the furnace, utilizing the relationship that when the ratio of $_2$ gas flow rate to the flow rate of the other gas is reduced, the ratio ($CO_2/(CO+CO_2)$) of the gas at the upper part or at the outlet of the furnace is increased, and reversely, when the ratio of $O_2$ gas flow rate to the flow rate of the other gas is increased, the ratio ($CO_2/(CO+CO_2)$) of the gas is decreased, the relationship that when the metal bath level in the furnace is lowered, the ratio ($CO_2/(CO+CO_2)$) of the gas at the upper part or at the outlet of the furnace is increased, and reversely, when the metal bath level in the furnace is raised, the ratio ($CO_2/(CO+CO_2)$) of the gas is decreased, and the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased;

a sixteenth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat, said method being characterized in that a part of the $O_2$ gas does not combust in the metal bath and leaves the metal bath unburnt, and to perform the second combustion of the unburnt $O_2$ gas with CO gas in the slag, a double-layer gas flow comprising an inner $O_2$ gas flow of a large diameter and an outer flow of a gas other than $O_2$, such as $N_2$ gas or air, the latter surrounding the former, is blown into the furnace through tuyeres installed near the bottom of the furnace, the ratio ($CO_2/(CO+CO_2)$) of the gas at the upper part or at the outlet of the furnace can be adjusted by controlling the ratio of the $O_2$ gas flow rate to the flow rate of the different gas, the metal bath level in the furnace and the pressure in the furnace, utilizing the relationship that when the ratio of $O_2$ gas flow rate to the flow rate of the other gas is reduced, the ratio ($CO_2/(CO+CO_2)$) of the gas at the upper part or at the outlet of the furnace is increased, and reversely, when the ratio of the $O_2$ gas flow rate to the flow rate of the other gas is increased, the ratio ($CO_2/(CO+CO_2)$) of the gas is decreased, the relationship that when the metal bath level in the furnace is lowered, the ratio ($CO_2/(CO+CO_2)$) of the gas at the upper part or at the outlet of the furnace is increased, and reversely, when the metal bath level in the furnace is raised, the ratio ($CO_2/(CO+CO_2)$) of the gas is decreased, and the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased;

a seventeenth feature of the present invention comprising a molten metal producing and refining method wherein a metal-containing material, a carbonaceous material, a flux and $O_2$ gas are introduced into a furnace, the carbon dissolving into the metal bath in the furnace from the carbonaceous material is combusted with the $O_2$ gas to generate heat and CO gas, the CO gas is subjected to the second combustion with the $O_2$ gas to additionally generate heat, and the metal-containing material is melted and refined by both the generated heat and carbon, said method being characterized in that a part of the $O_2$ gas does not combust in the metal bath and leaves the metal bath unburnt, and to perform the second combustion of the unburnt $O_2$ gas with CO gas in the slag, $O_2$ gas is mixed with a different kind of gas such as $N_2$ or air and said mixed gases are blown into the furnace through a plurality of large-diameter tuyeres and a plurality of small-diameter tuyeres installed near the bottom of the furnace, the metal-containing material is melted and refined while the CO concentration and the $CO_2$ concentration in the upper part or at the outlet of the furnace are measured, and the ratio ($CO_2/(CO+CO_2)$) of the gas at the upper part or at the outlet of the furnace can be adjusted by controlling the above-mentioned $O_2$ gas flow rate and the gas flow rate of the different gas, the metal bath level in the furnace, and the pressure in the furnace, utilizing the relationship that when the metal bath level in the furnace is lowered, the ratio ($CO_2/(CO+CO_2)$) of the gas at the upper part or at the outlet of the furnace is increased, and reversely, when the metal bath level in the furnace is raised, the ratio ($CO_2/(CO+CO_2)$) of the gas is decreased, and the relationship that when the pressure in the furnace is reduced, the ratio ($CO_2/(CO+CO_2)$) of the gas at the upper part or at the outlet of the furnace is increased, and reversely, when the pressure in the furnace is increased, the ratio ($CO_2/(CO+CO_2)$) of the gas is decreased.

BRIEF DESCRIPTION OF THE DRAWINGS

With reference to the attached drawings, an application of a preferred embodiment of the present invention to an iron ore smelting reduction furnace will be described.

FIG. 8 is a sectional view of a molten metal producing and refining apparatus of the prior art I.

FIG. 9 is a sectional view of a molten metal producing and refining apparatus of the prior art II.

FIG. 10 is a sectional view of a molten metal producing and refining apparatus of the prior art III.

DETAILED DESCRIPTION OF THE INVENTION

Figure 1:
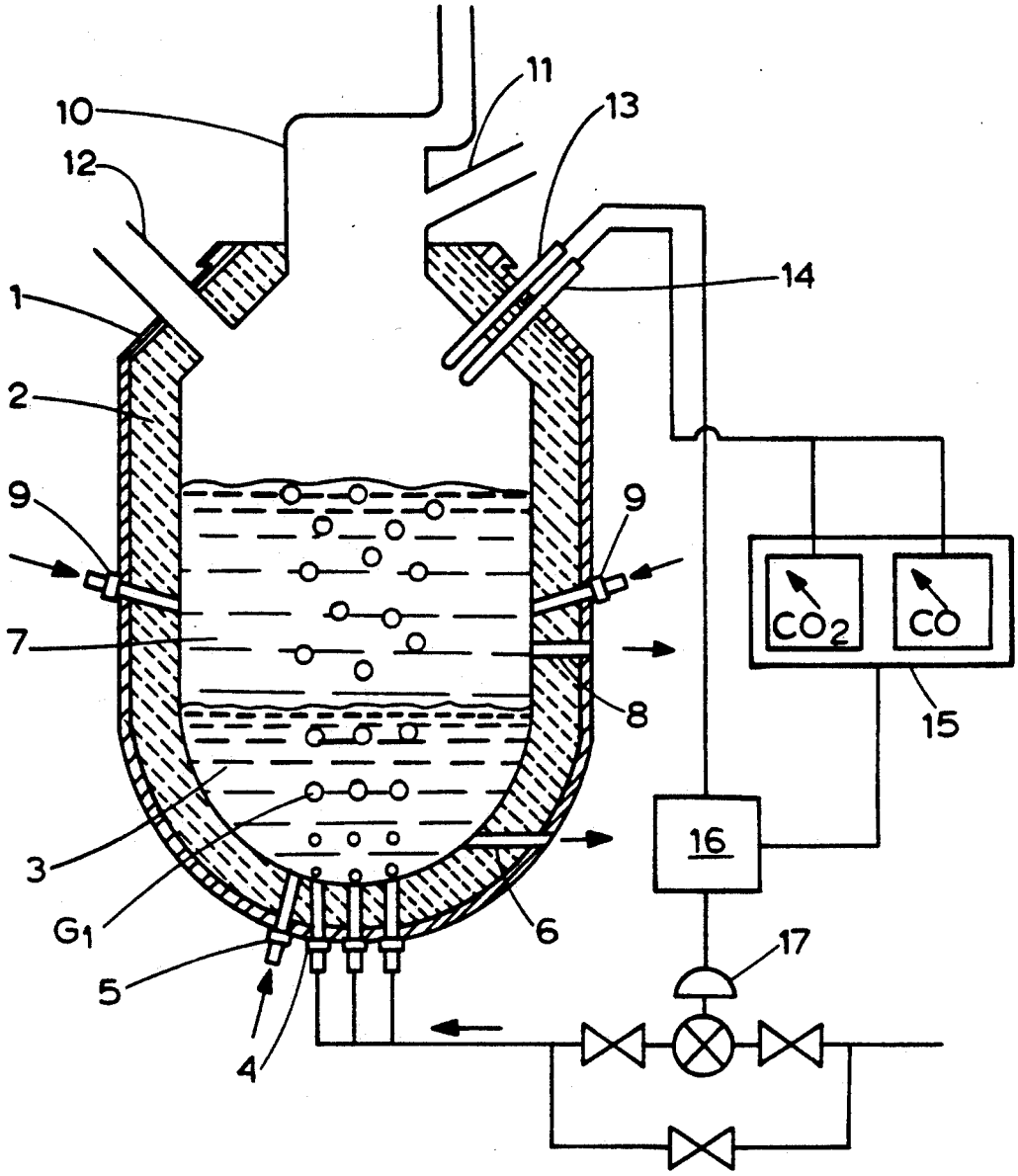
FIG. 1 is a sectional view of an apparatus for practicing a molten metal producing and refining method according to the present invention.

In FIG. 1, 1 denotes an iron ore smelting reduction furnace of which interior is lined with refractory material 2, and the furnace 1 is provided, in the furnace bottom, with bottom-blown tuyeres 4 which are able to introduce large-diameter bubbles of oxygen ($G_1$) in the metal bath 3 in the furnace and with a nozzle 5 for blowing into a stirring gas. A tap hole 6 is provided near the above-mentioned tuyeres 4 and nozzle 5. A slag-off port 8 and side-blown gas tuyeres 9 for a stirring gas are provided in the furnace side wall for exhausting and stirring the slag bath 7 above the metal bath 3. Moreover, the opening in the top of the furnace is connected to an exhaust gas duct 10, and near the exhaust gas duct 10 are provided with a chute 11 for charging iron ore preheated and prereduced in a prereduction furnace (not illustrated) into the furnace 1 and a chute 12 for charging the carbonaceous material and the flux. 13 denotes a thermometer for measuring the gas temperature in the upper portion of the furnace. 14 denotes a gas sampler, and 15 denotes a gas analyzer for measuring CO and $CO_2$. 16 denotes a transducer/controller, and 17 denotes a control valve for controlling the flow rate of $O_2$ blown into the furnace. The smelting reduction furnace in the present embodiment denotes the molten metal producing and refining apparatus. Moreover, in the present invention, a tuyere provided near the bottom of the furnace denotes a tuyere provided in the bottom of the furnace up to a point close to the tap hole 6, and in the present embodiment, the bottom-blown tuyeres 4 are such tuyeres provided near the bottom of the furnace.

Figure 2:
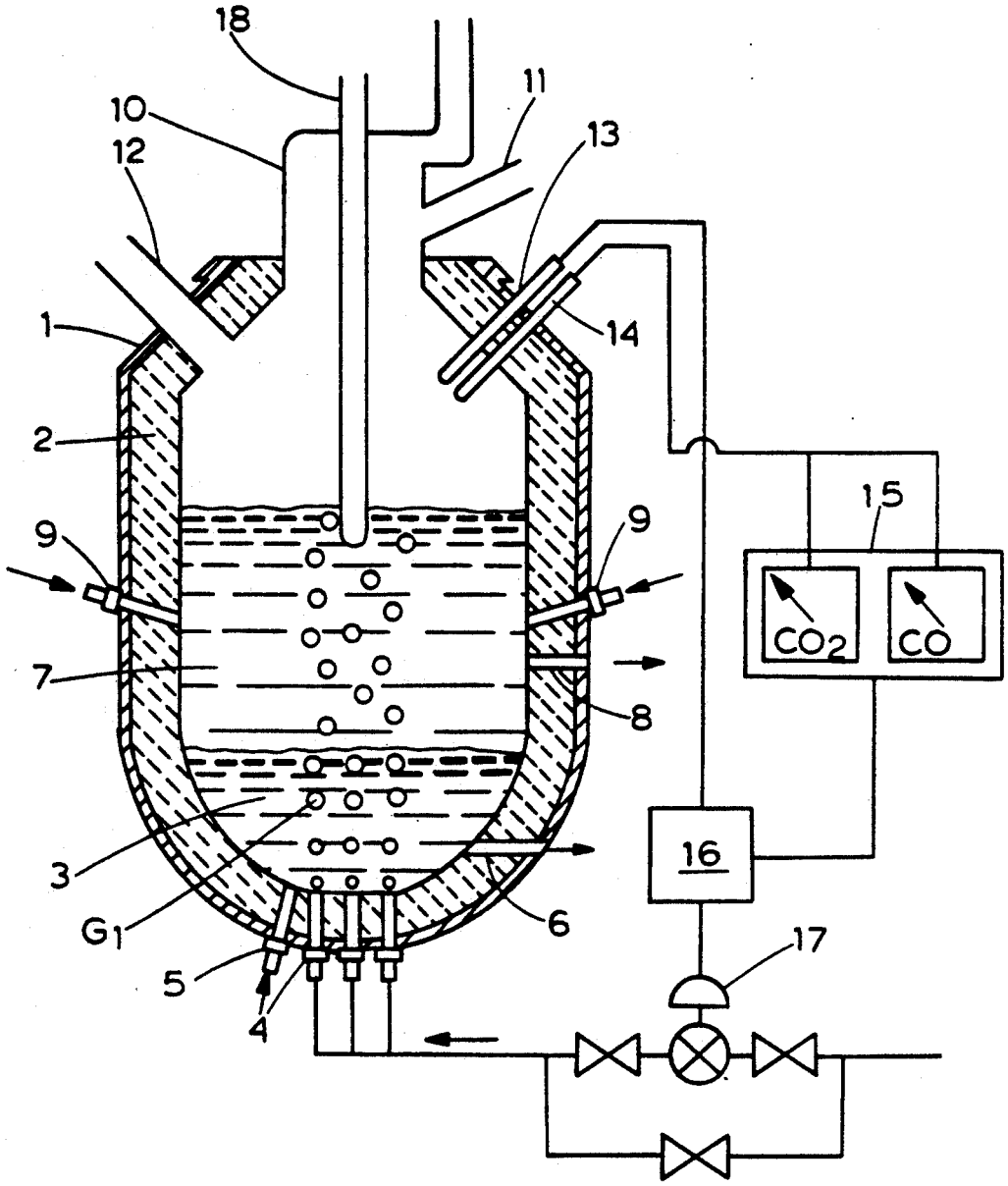
FIG. 2 is a sectional view of an apparatus for practicing a molten metal producing and refining method according to the present invention, said apparatus having an top-blown $O_2$ lance.

FIG. 2 is a diagram showing the state where the top-blown $O_2$ lance 18 is inserted from the top of the furnace into the slag bath 7.

Next, the effect of the present invention in the above-mentioned configuration will be explained in two areas; in the metal bath and in the slag bath.

(Effect in the Metal Bath)

If the diameter of the bubbles of oxygen blown into the furnace through the bottom-blown tuyeres 4 in the bottom is small, the total quantity of the oxygen will be reacted with the carbon dissolved in the metal bath 3 as shown by the following equation (1) to produce CO gas:

$$C+\tfrac{1}{2}O_2 \rightarrow CO \qquad (1)$$

In the present invention, however, the diameter of the bubbles of oxygen is large. Hence only the surface portions of the oxygen bubbles will react with carbon to produce CO gas, and a part of the CO gas will react with the remaining oxygen in the bubbles to produce $CO_2$, and CO, will react with C to produce CO gas again as shown in the following equations (2), and the CO gas will rise. The reaction, however, will not be completed within the time the bubbles pass through the metal bath since the bubbles are large.

$$CO+\tfrac{1}{2}O_2 \rightarrow CO_2,\ CO_2+C \rightarrow 2CO \qquad (2)$$

Thus the gas coming out of the metal bath will comprise CO, $O_2$ and $CO_2$, and this mixed gas will enter the slag bath 7. The heat generated by the above-mentioned reactions (1) and (2) of the mixed gas in the metal bath will be given to the metal bath.

On the other hand, the ore charged into the furnace through the chute 11 in the top of the furnace receives the heat generated by the above-mentioned reactions (1) and (2) to melt. The ore is reduced by carbon contained in the metal bath to turn into molten metal. The molten metal thus produced is taken out of the tap hole 6 provided at the lower part of the furnace.

The carbon in the metal bath is thus consumed by the above-mentioned reactions. To supply the carbon, coal is charged into the furnace through the chute 12 as required.

(Effect in the Slag Bath)

The mixed gas comprising CO, $O_2$ and $CO_2$ enters the slag bath 7 from the metal bath 3 as described above and rises in the form of bubbles in the slag bath 7. During the ascent, with the passage of time, the gases in the bubbles will be mixed well, and CO and $O_2$ will react with each other to form $CO_2$ and to generate heat. Not like the prior art where the second combustion $O_2$ gas and the CO gas are separated from each other, the bubbles in this invention entering the slag contain both $O_2$ and CO for combustion. The second combustion rate in the slag, therefore, is quite satisfactory. Moreover, the heat of combustion is given to the slag bath 7. As the slag bath 7 is strongly stirred or circulated by the stirring gas blown into the slag bath 7 from the side-blown gas tuyeres 9 on the furnace side wall and bottom-blown gas tuyeres 9 on the furnace bottom, the above-mentioned heat of combustion generated in the slag bath 7 is transferred to the metal bath 3 through the interface between the slag bath 7 and the metal bath 3.

After the latent heat retained in the form of the latent heat of the material (carbon) is converted to sensible heat and is transferred to the metal bath quite efficiently, the combustion exhaust gas emitted from the slag bath 7 will rise the upper space in the furnace, and will be discharged out of the system through the exhaust gas duct 10.

Moreover, in the above-mentioned reaction process, slag is discharged through the slag-off port 8 provided in the furnace side wall, and the flux is charged through the chute 12 at the top of the furnace as needed, so as to keep the quantity and quality of slag in the furnace at a specified value.

As an alternative of the basic process of the bottom-blowing $O_2$ method, where the oxygen gas is introduced into the furnace through the only tuyeres on the bottom of the furnace, as described above, top- and bottom-blowing $O_2$ method may be performed by using top-blowing $O_2$ lance as well. For instance, the coal, which is the source of carbon for the metal bath 3, contains some combustible volatile matter, and this volatile matter rises in the metal bath 3 and reaches the slag bath 7. The volatile matter is combusted by the oxygen blown into the slag bath 7 through the top-blown $O_2$ lance 18 (see FIG. 2) or through the side-blown tuyeres 9 to generate heat. The heat generated in the slag bath 7 is effectively transferred to the metal bath since the slag bath is fairly stirred as described above. In this way, the latent heat retained in the form of the volatile matter can be converted to sensible heat and can be recovered in the metal bath effectively.

Figure 3:
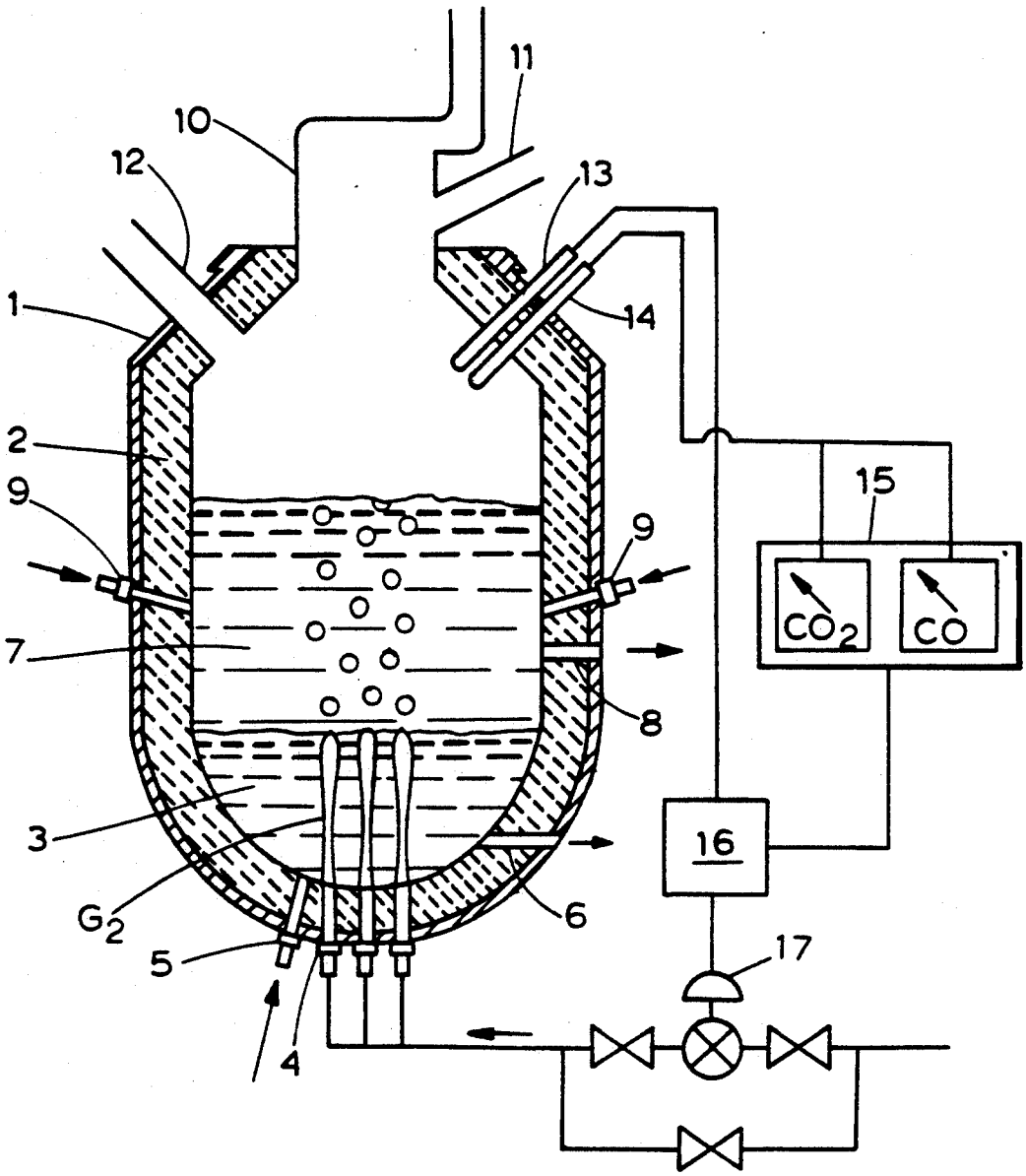
FIG. 3 is a sectional view of an apparatus for practicing a molten metal producing and refining method according to the present invention, indicating a case where oxygen is blown into the furnace in the long tail-shaped flows of large diameters in the metal bath.

In either the case of bottom-blowing or the case of top- and bottom-blowing, the basic and common characteristic of the present invention is that "unburnt $O_2$ is left in the gas shifting from the metal bath 3 into the slag bath, and the unburnt $O_2$ is subjected to the second combustion in the slag." In addition to the above-mentioned methods, the following methods may be performed to accomplish this characteristic:

(1) A method of blowing long-tail-shaped oxygen flows of large-diameter (G2) as shown in FIG. 3.

When the quantity of oxygen-containing gas blown into the furnace is increased, the flows will form longer tails in the metal bath. When the diameters of these tails are small, most of the oxygen contained in the long-tails will be converted into CO gas. When the diameters of the oxygen flows are increased, only the surface portions of the streams will become CO gas, and unburnt oxygen will remain inside the gas streams moving from the metal bath 3 into the slag bath 7. As the result, a second combustion as efficient as those described above may be expected.

Figure 7:
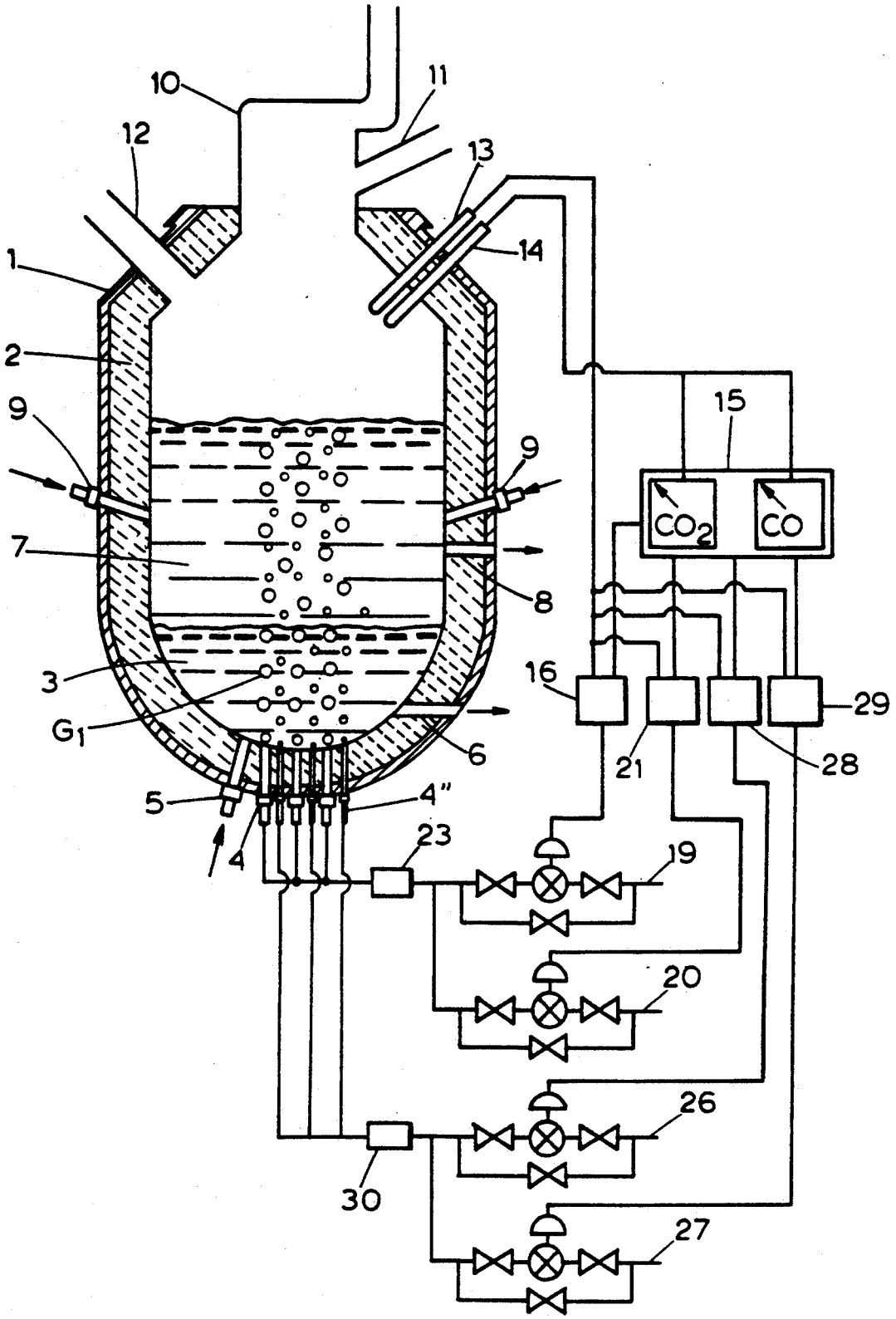
FIG. 7 is a sectional view of an alternative apparatus for practicing a molten metal producing and refining method according to the present invention, indicating a case where mixed gases comprising $O_2$ gas and an inert gas are blown into the furnace through a plurality of large-diameter tuyeres and a plurality of small-diameter tuyeres.
Figure 11:
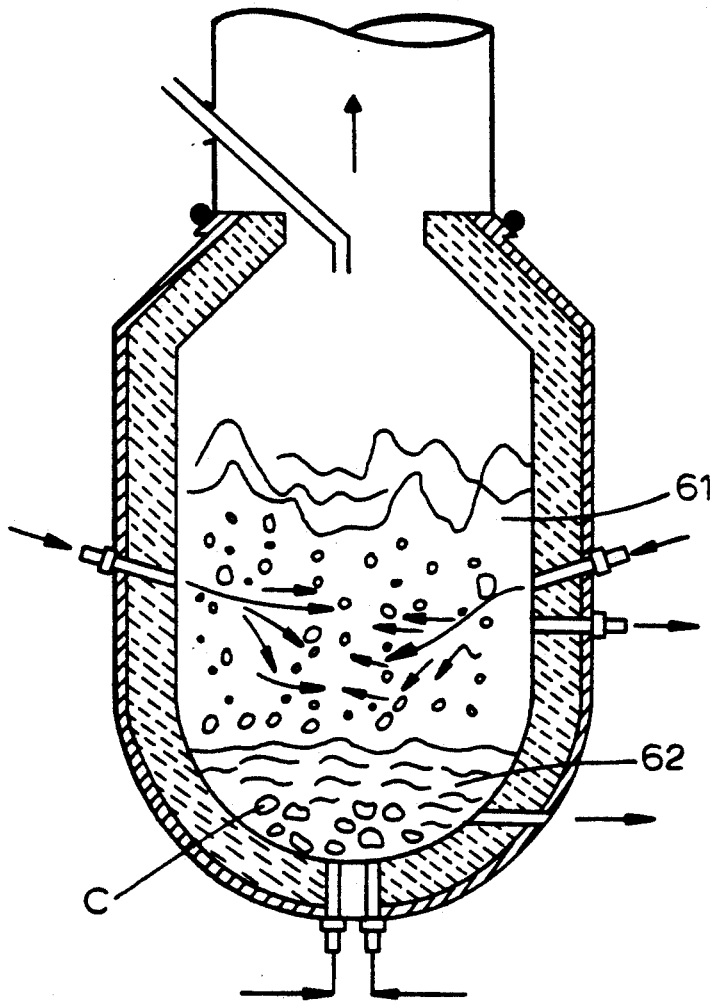
FIG. 11 PRIOR ART
FIG. 11 is a sectional view of a molten metal producing and refining apparatus of the prior art IV.

(2) A method of producing mixed presence of minute bubbles of oxygen and large-diameter bubbles of oxygen as shown in FIG. 7.

Most of the minute bubbles of oxygen will become CO gas in the metal bath 3, but they will be subjected to the second combustion by the unburnt oxygen contained in the large-diameter bubbles of oxygen in the slag 7; thus an improvement in the second combustion rate may be expected.

Figure 4:
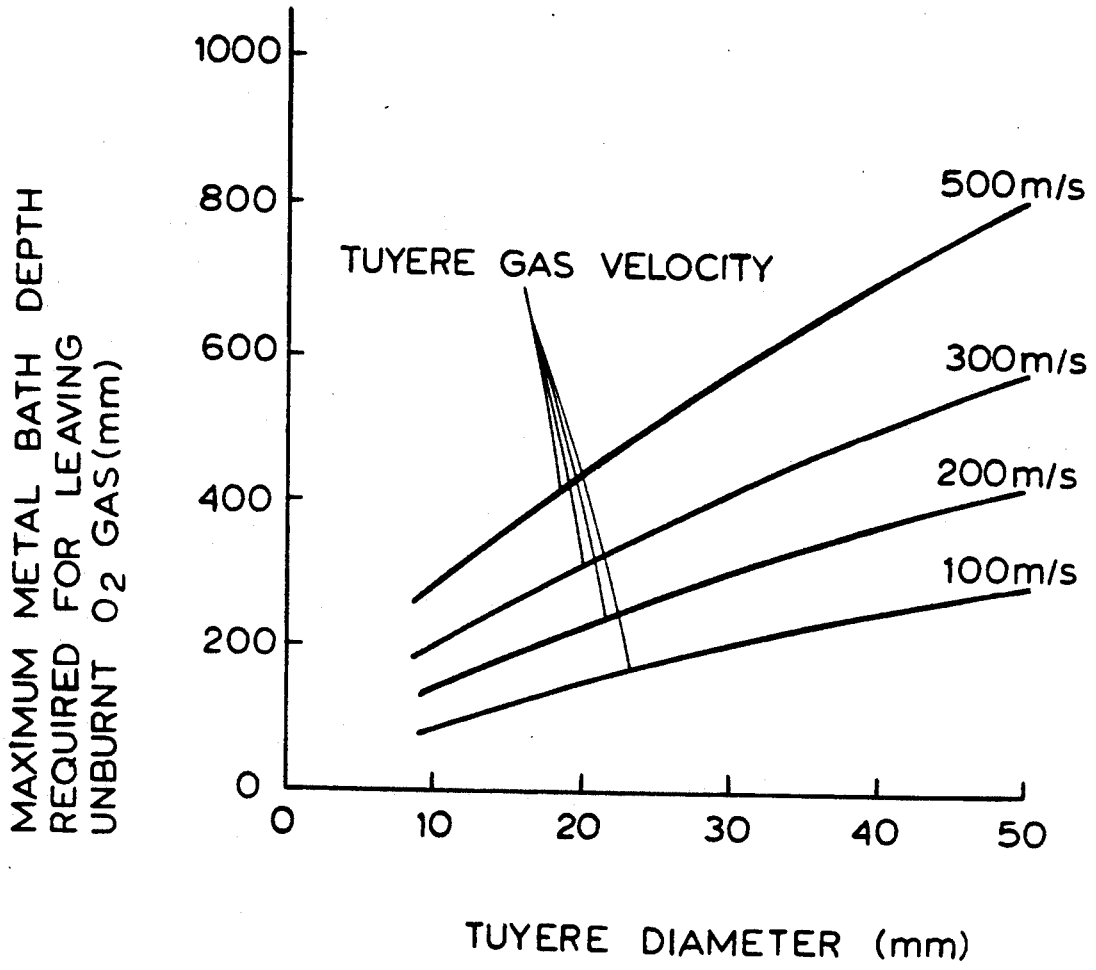
FIG. 4 is a diagram showing the relationship of the maximum metal bath depth required for leaving unburnt $O_2$ gas in the gas coming out of the metal bath, the tuyere diameter and the velocity of the gas blown into through the tuyere.

A method similar to this method is the above-mentioned method of (1) in which minute bubbles of oxygen or small-diameter long-tail-shaped flows of oxygen are blown into the furnace simultaneously. So far the basic processes of the second combustion methods according to the present invention were described. FIG. 4 shows examples of critical conditions for the characteristic of the present invention that "a part of $O_2$ gas blown into the metal bath near the bottom of the furnace leaves unburnt from the metal bath." As clearly seen in the diagram, the progress of the second combustion according to the present invention depends on three factors; "depth of the metal bath," "diameter of tuyere" and "velocity of gas from tuyere." Accordingly, when the second combustion is controlled by appropriate combinations of the methods according to the present invention and these factors, the production of molten metal may be adjusted, the unit requirement of the auxiliary material (coal) may be reduced, and the facilities of melting reduction furnace may be protected. Next, the effects of the respective factors will be described.

① Depth of metal bath

If the depth of the metal bath is shallow, the time of contact between the $O_2$ gas blown into the furnace and the metal bath will be short. Hence the quantity of unburnt oxygen in the gas comprising CO, $O_2$ and $CO_2$, which shifts from the metal bath into the slag bath will be increased. However, if the metal bath depth is too shallow, the unburnt oxygen may not be consumed in the slag bath and may be combusted above the slag bath. This, in turn, may result in an increase of the auxiliary material (coal) consumption rate and/or damage of the refractories inside the furnace. On the other hand, if the depth of the metal bath is greater, the time of contact between the $O_2$ gas blown into the furnace and the metal bath will become longer. Hence the quantity of the unburnt oxygen in the gas comprising CO, $O_2$ and $CO_2$, which shifts from the metal bath into the slag bath will be reduced. This, in turn, may result in a drop in the second combustion rate and a drop in the production of hot metal.

On such grounds, it is necessary to set the depth of the metal bath within an appropriate range. When stable operation must be assured, the metal bath depth of 300 mm or under is not desirable. On the other hand, to leave unburnt $O_2$ gas in the gas coming out of the metal bath, it is desirable to set the upper limit of the metal bath depth at 1,000 mm according to FIG. 4.

As clearly seen in FIG. 4, the second combustion rate may be controlled by changing the depth of the metal bath.

② Tuyere diameter (diameter of oxygen flow blown into metal bath from furnace bottom) and velocity of gas from tuyere As described above, the greater is the diameter of oxygen flow, the more effective is the second combustion. It, therefore, is necessary to have a large tuyere diameter. When the tuyere diameter is constant, the second combustion rate will change with the velocity of the gas blown into through the tuyere. For instance, according to FIG. 4, when the metal bath depth is 300 mm and the tuyere diameter is 30 mm, and the velocity of the gas blown into through the tuyere is 200 m/sec or lower, all of the $O_2$ gas blown into the furnace will react with C contained in the metal bath to produce CO gas. If the velocity of the gas blown into through the tuyere is greater than 200 m/sec, unburnt $O_2$ gas will be present in the gas coming out of the metal bath. The greater is the velocity of the gas, the greater is the quantity of the unburnt $O_2$ gas. Then the unburnt $O_2$ gas will combust (second combustion) with CO gas above the metal bath to produce $CO_2$. This second combustion rate is equal to the ratio of the quantity of unburnt $O_2$ gas to the total quantity of $O_2$ gas blown into the furnace. Table 1 shows examples of second combustion rate when the metal bath depth is 300 mm.

TABLE 1

| Tuyere diameter (mm) | 30 | | 50 | |
|---|---|---|---|---|
| Tuyere gas velocity (m/sec) | 300 | 350 | 200 | 300 |
| Second combustion rate (%) | 20 | 30 | 30 | 45 |

Methods for increasing or decreasing the velocity of the gas blown into the furnace through tuyere may include, for example, the following three methods:

(1) To increase or decrease the flow rate of oxygen to be blown into the furnace.

Figure 5:
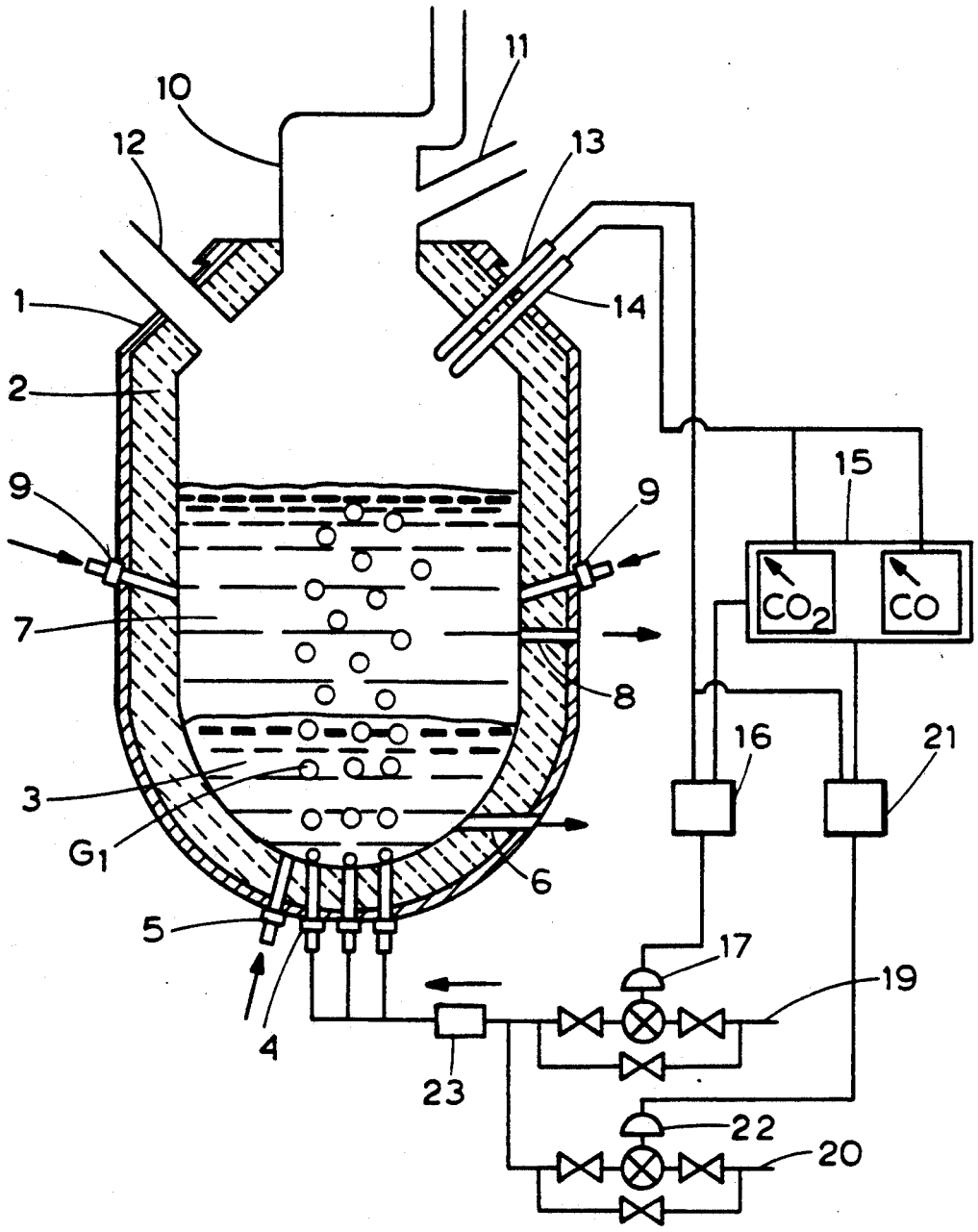
FIG. 5 is a sectional view of an alternative apparatus for practicing a molten metal producing and refining method according to the present invention, indicating a case where mixed gases comprising $O_2$ gas and an inert gas are blown into the furnace.

(2) To increase or decrease the flow rate of the gas to be mixed with the oxygen to be blown into the furnace, as shown in FIG. 5.

(3) To change the actual volume of the tuyere gas by altering the pressure in the furnace.

The effects on the second combustion rate of altering these factors may be determined by measuring, with the analyzer 15, the concentrations of CO and $CO_2$ in the gas at the upper part of the furnace sampled by the gas sampler 14. The state that the "$CO_2$ concentration is high and the CO concentration is low in the gas taken in the upper furnace" indicates that "the second combustion has a high efficiency." Reversely, the state that "the CO, concentration is low and the CO concentration is high in the above-mentioned gas" indicates that "the efficiency of the second combustion is low." Accordingly, if we can know the ratio of the CO, concentration to the CO concentration + the $CO_2$ concentration (hereinafter referred to as the "the ratio of $CO_2$ in waste gas"), this ratio of $CO_2$ in waste gas may be used as a guide for judging the efficiency of the second combustion, and in turn, effective measures may be taken. Next, the operation methods will be explained specifically for two cases; when the ratio of $CO_2$ in waste gas is smaller than the demanded preset range and when the ratio is larger than the preset range. (When the ratio of $CO_2$ in waste gas becomes smaller than the demanded preset range)

In this case, the second combustion ratio shall be increased and an appropriate action is to increase the velocity of $O_2$ or $O_2$-containing gas blown into the reactor through the tuyere (oxygen flow rate). As the time of contact between $O_2$ gas and metal bath becomes shorter, the quantity of unburnt $O_2$ in the gas coming out of the metal bath will be increased together with CO and $CO_2$. This unburnt $O_2$ will be subjected to the second combustion with CO in the slag bath above the metal bath to produce $CO_2$. As the result, the ratio of $CO_2$ in exhaust gas will be improved. (When the ratio of $CO_2$ in exhaust gas becomes greater than the demanded preset range)

This case indicates that the second combustion has a very high efficiency. At the same time, the gas temperature in the furnace may rise excessively. It may be necessary to suppress the second combustion from the viewpoint of protection of the facilities. An appropriate action is to reduce the velocity of the gas blown into the furnace through the tuyere (oxygen flow rate). As the time of contact between $O_2$ gas and metal bath becomes longer, a large quantity of the $O_2$ gas will be consumed by the reaction with the dissolved carbon in the metal bath, and the quantity of the unburnt $O_2$ gas will be reduced. As the result, the ratio of $CO_2$ in exhaust gas will be decreased.

As explained above, the $O_2$ or $O_2$-containing gas flow rate is one of important factors having an influence on the second combustion rate. This gas flow rate is also an important control item in adjustment of the production and protection of facilities. In other words, the quantity of the gas is one of the factors that determine the total amount of heat generated by the second combustion. The production of hot metal can be adjusted by changing the quantity of the gas blown into the furnace. On the other hand, the quantity of the gas must be considered from the viewpoint of protection of the facilities. For example, to protect the refractories in the furnace, it is possible to adjust the control valve 17 when the gas temperature in the upper part of the furnace measured by a thermometer 13 reaches the heat resistant temperature (from 1,700° to 1,800° C.) of the refractories. The control of the valve 17 will reduce the flow rate of oxygen blown into the furnace, and in turn, will control the total amount of heat of combustion, reducing the highest temperature in the furnace.

As described in detail above, the most important point for accomplishing the objective of the present invention is to blow into large-diameter $O_2$ gas into the furnace near the bottom thereof. An inert gas, however, may be used for "promoting the reactions through agitation" and for "improving the second combustion rate by lowering the amount of reacted $O_2$." The methods and effects of blowing an inert gas into the furnace will be described in detail in the following.

(Stirring of metal bath)

(a) The slag bath is located above the metal bath. From the viewpoint of metallurgical effects (for instance, to shift sulfur contained in the metal bath to the slag), it is necessary to improve the contact between the metal bath and the slag bath. The contact between the metal bath and the slag bath will be enhanced if an inert gas is blown into both baths to stir them.

(b) In the present invention, as the second combustion is performed in the slag bath to generate heat, the temperature of the slag bath will be raised. To transfer the heat of the slag bath to the metal bath and promote the reactions effectively, an inert gas is blown into the metal bath and the slag bath to stir them. The contact between both the baths will be improved. The heat generated when a part of $O_2$ reacts with C, the heat consumed when iron oxide is reduced, and heat transferred from the slag bath to the metal bath are balanced in total in the metal bath; the reactions will proceed effectively.

To effect the stirring of (a) and (b) above, an inert gas such as $N_2$ may be blown into the furnace through the side-blown tuyeres 9 or the nozzle 5 at the bottom of the furnace of FIG. 1.

(Improvement of second combustion rate)

All methods are eventually intended to improve the second combustion rate, but they may be divided into the following two methods:

(c) Reduction in reaction of $O_2$ through the mixture of an inert gas in $O_2$ gas This case may be divided into two cases; when the total flow rate of the gases blown into the furnace is increased and when the total flow rate is not increased.

① When the total flow rate of gas blown into the furnace is increased

If the quantity of $O_2$ gas is kept constant and an inert gas such as $N_2$ is added, the total flow rate of the gases blown into the furnace will be increased. The velocity of the gas blown into the furnace through the tuyere will become larger, and as a result, the second combustion rate will be improved. For instance, as shown in Table 1, when the tuyere diameter is 50 mm and the metal bath depth is 300 mm, if $O_2$ gas is blown into the furnace at the tuyere gas velocity of 200 m/sec, the second combustion rate will be 30%. If $N_2$ of which flow rate is 50% of that of the $O_2$ gas is added to the $O_2$ gas, the velocity of the mixed gases blown into the furnace through tuyere will be 300 m/sec, and the second combustion rate will be over 45%. As will be clear from the following explanation, the achievement of over 45% is attributed to that the gas added to $O_2$ gas is inert $N_2$ gas. $N_2$ gas also suppresses the reaction of $O_2$ gas and C in the metal bath.

② When the total flow rate of gases blown into the furnace is not increased

In this case, the greater is the quantity of $N_2$ gas to be mixed with $O_2$ gas, the smaller is the amount of reaction between $O_2$ gas and C in the metal bath. Reversely, the second combustion rate is increased. For example, as shown above, when the tuyere diameter is 30 mm and the metal bath depth is 300 mm, if the tuyere gas velocity is 300 m/sec and the gas blown into the furnace is $O_2$ only, the second combustion rate will be 20%. If the gas blown into the furnace comprises $O_2$ by 50% and $N_2$ by the remaining 50%, the second combustion rate will be raised to 30%.

An example of a facility for mixing $O_2$ gas to be blown into the furnace with $N_2$ gas is shown in FIG. 5. A $N_2$ feed line 20 for transferring $N_2$ is installed in parallel with an $O_2$ feed line 19 for transferring $O_2$. According to the values of concentrations of $CO_2$ and CO in the upper furnace gas measured by the analyzer 15, the transducer/controller 16 and/or 21 increase or decrease the flow rate of $O_2$ by the control valve 17 and/or the flow rate of $N_2$ by the control valve 22. Both the gases are mixed by the mixer 23 and blown into the furnace through the large-diameter bottom-blown tuyeres 4 in the bottom of the furnace.

The bottom-blown tuyeres 4 shown in FIG. 5 have large diameters. As shown in FIG. 7 each of three large-diameter bottom-blown tuyeres 4 may be provided with a small-diameter bottom-blown tuyere 4''. The gas flow rates of the $O_2$ feed line 19 and the $N_2$ feed line 20 connected to the large-diameter bottom-blown tuyeres 4 and of the $O_2$ feed line 26 and the $N_2$ feed line 27 connected to the small-diameter bottom-blown tuyeres 4'' may be adjusted to alter the ratio of $CO_2$ in exhaust gas, and in turn, to adjust the second combustion rate in the same manner as described above. In this case, the effects of the small-diameter bottom-blown tuyeres may be expected to be basically the same as those of the above-mentioned large-diameter bottom-blown tuyeres except "the quantity of unburnt $O_2$ in the gas coming out of the metal bath into the slag bath depends on the size of the diameter." 28 and 29 denote transducer/controllers, and 30 denotes a mixer.

Figure 6:
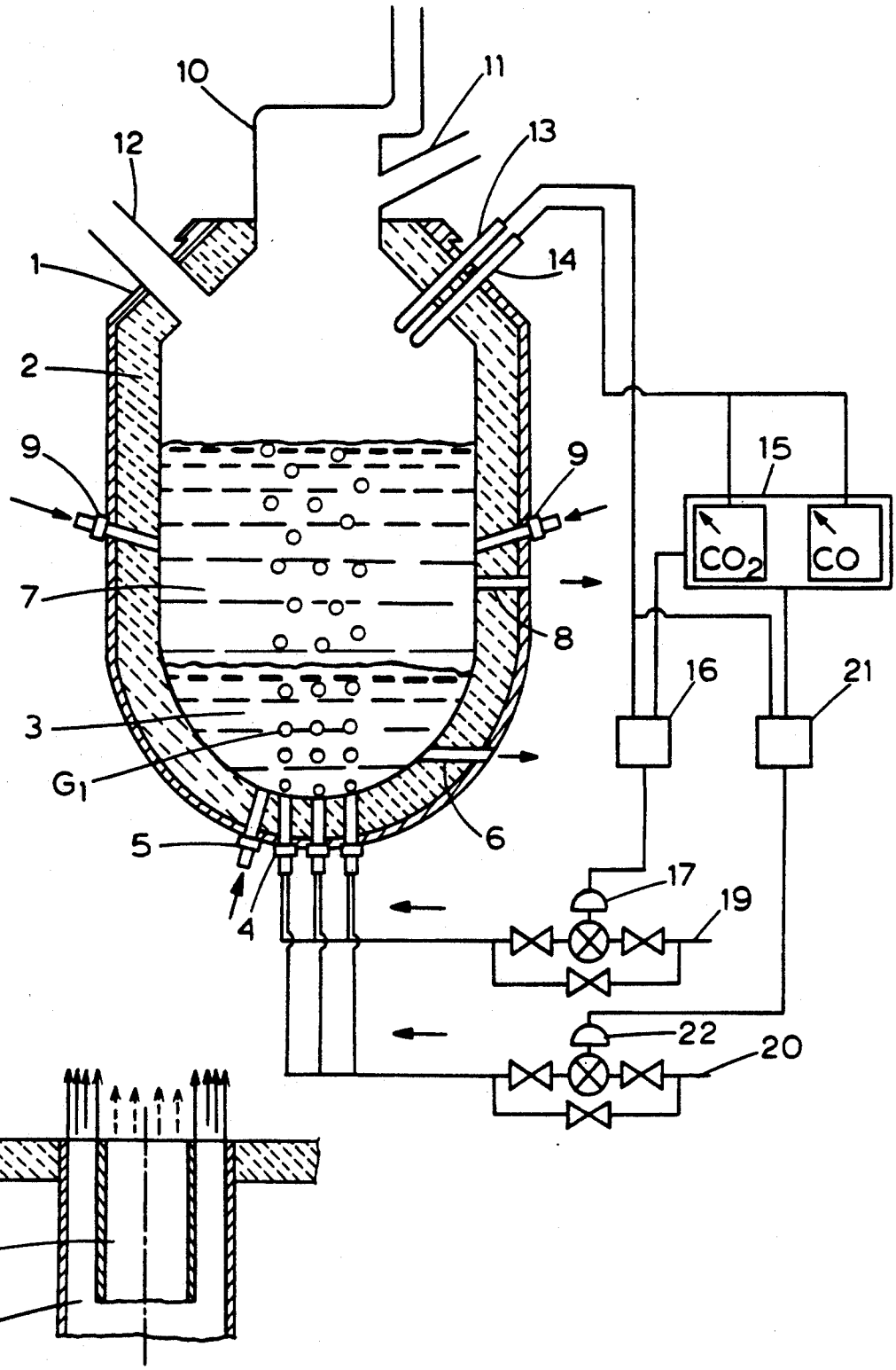
FIG. 6 (*a*) is a sectional view of an alternative apparatus for practicing a molten metal producing and refining method according to the present invention, indicating a case where $O_2$ gas and an inert gas are blown into the furnace in a double-tube form, FIG. 6 (*b*) is a enlarged view of the tuyere of the furnace shown in FIG. 6 (*a*)

(d) Decrease in reacted $O_2$ gas due to isolation of $O_2$ gas from the metal bath As shown in FIG. 6 (*a*), an $N_2$ feed line 20 is provided in parallel with an $O_2$ feed line 19. Three large-diameter bottom-blown tuyeres 4' in the bottom of the furnace are directly connected to the $O_2$ feed line 19 and the $N_2$ feed line 20. The tuyeres 4' have a double tube structure as shown in an enlarged view of FIG. 6 (b). $O_2$ gas is blown into the furnace through the inner tube 24, and $N_2$ gas is blown into the furnace through the outer tube 25; thus the $N_2$ gas surrounds the $O_2$ gas. Near the tuyeres, the $O_2$ gas and the metal bath are isolated from each other by the $N_2$ gas. As the result, the amount of reaction of $O_2$ gas in the metal bath will be very small. The gas coming out of the metal bath will contain much unburnt $O_2$ gas, and the second combustion rate will be improved.

An inert gas such as $N_2$ may be added to oxygen to reduce the amount of reaction of $O_2$ and C, and in turn, to lower the highest temperature in the furnace and protect the refractories in the furnace. In the above-mentioned respective embodiments $N_2$ gas is used as the inert gas. Air may be used in place of $N_2$. Since air contains $O_2$, an effect of reduction in the consumption of expensive $O_2$ may be expected as well.

Since the present invention is arranged as described above, it has the following effects:

(1) Since the contact and reaction of the second combustion $O_2$ gas and the gas to be combusted (CO gas) are made very effectively, a high second combustion rate may be achieved.

(2) The second combustion is performed mainly in the slag bath, and the heat generated by the second combustion is effectively absorbed by the slag bath. This heat is efficiently transferred to the metal bath through the metal bath interface being in stirring direct contact with the slag bath. Hence the heat of reaction retained in the gas coming out of the furnace is small, and the efficiency of recovery of the heat generated in the furnace is very high.

(2) As the second combustion is effected evenly in the slag bath or in the metal bath, the metal bath is not heated locally. Hence the consumption rate of the refractories in the furnace will be reduced.

(4) The amount of reaction of $O_2$ gas may be reduced, and in turn, the second combustion rate may be controlled with ease by controlling the $O_2$ gas flow rate or the inert gas flow rate blown into the furnace near the bottom thereof, or by surrounding the $O_2$ gas with the inert gas.

(5) The highest temperature in the furnace may be reduced, and in turn, the refractories in the furnace may be protected by controlling the $O_2$ gas flow rate or the inert gas flow rate blown into the furnace near the bottom thereof.

We claim:

1. A molten metal producing and refining method employing a furnace having large-diameter tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing large bodies of gas including oxygen through said tuyeres and into said metal bath;

e) combusting said dissolved carbon and a first part of said oxygen in said metal bath for heating and refining the metal containing material and leaving a second part of the oxygen unburnt; and f) performing a second combustion in said slag bath by combining said CO gas and the second part of said oxygen in said large bodies.

2. The method of claim 1, wherein said furnace has a gas outlet, and, in Step (f), $CO_2$ is produced by said second combustion, and further including the step of including a second gas in said large bodies of gas, and the step of adjusting the ratio $CO_2/(CO+CO_2)$ of gas adjacent said gas outlet by controlling the ratio of oxygen flow rate and said second gas flow rate in said large bodies such that when the ratio of the oxygen flow rate to the second gas flow rate is reduced, the ratio $CO_2/(CO+CO_2)$ is increased, and vice versa.

3. A molten metal producing and refining method as set forth in claim 1, wherein said second combustion produces $CO_2$, and the ratio $CO_2/(CO+CO_2)$ of the gas above said slag bath is adjusted by controlling the flow rate of the oxygen gas or oxygen containing gas blown into the furnace, according to the relationship that when the flow rate of the oxygen gas or oxygen containing gas blown into the furnace is reduced, the ratio $CO_2/(CO+CO_2)$ is decreased, and reversely, when the flow rate of the oxygen gas or oxygen containing gas flown into is increased, the ratio $CO_2/(CO+CO_2)$ is increased.

4. A molten metal producing and relining method as set forth in claim 1, wherein said second combustion produces $CO_2$, and the ratio $CO_2/(CO+CO_2)$ of the gas above said slag bath is adjusted by controlling the metal bath level in the furnace, according to the relationship that when the metal bath level in the furnace is lowered, the ratio $CO_2/(CO+CO_2)$ of the gas above said slag bath is increased, and reversely, when the metal bath level in the furnace is raised, the ratio $CO_2/(CO+CO_2)$ of the gas is decreased.

5. A molten metal producing and refining method according to claim 1, wherein said second combustion produces $CO_2$, said furnace has an internal pressure, and the ratio $CO_2/(CO+CO_2)$ of the gas above said slag bath is adjusted by controlling the pressure in the furnace, according to the relationship that when the pressure in the furnace is reduced, the ratio $CO_2/(CO+CO_2)$ of the gas above said slag bath is increased, and reversely, when the pressure in the furnace is increased, the ratio $CO_2/(CO+CO_2)$ of the gas is decreased.

6. A molten metal producing and refining method according to claim 1, wherein oxygen gas or oxygen containing gas is also blown into the furnace adjacent the top or side of the furnace.

7. A molten metal producing and refining method employing a furnace having tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a double layer gas through said tuyeres and into said metal bath, said gas including a large diameter inner layer of oxygen and an outer layer surrounding said inner layer of a second gas other than oxygen;

e) combusting said dissolved carbon and a first part of said oxygen in said double layer gas to produce heat and CO gas in said metal bath and leaving a second part of the oxygen unburnt;

f) performing a second combustion in said slag bath by combining said CO gas and the second part of said oxygen in said double layer gas and producing $CO_2$;

g) and adjusting the ratio $CO_2/(CO+CO_2)$ of the gas above said slag bath by controlling the ratio of the oxygen gas flow rate to the flow rate of the second gas according to the relationship that when the ratio of $O_2$ gas flow rate to the flow rate of the second gas is reduced, the ratio $CO_2/(CO+CO_2)$ of the gas above said slag bath is increased, and reversely, when the ratio of the oxygen gas flow rate to the flow rate of the second gas is increased, the ratio $CO_2/(CO+CO_2)$ of the gas is decreased.

8. A molten metal producing and refining method employing a furnace having a plurality of large-diameter tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a gas mixture of oxygen and a different kind of gas through said tuyeres and into said metal bath;

e) combusting said dissolved carbon and a first part of said oxygen in said gas mixture to produce heat and CO gas in said metal bath for heating and refining the metal containing material and leaving a second part of the oxygen unburnt;

f) performing a second combustion in said slag bath by combining said CO gas and the second part of said oxygen in said gas mixture and producing $CO_2$;

g) measuring the CO concentration and the $CO_2$ concentration above said slag bath, and adjusting the ratio $CO_2/(CO+CO_2)$ of the gas above said slag bath by controlling the oxygen flow rate and the gas flow rate of said different kind of gas in said gas mixture.

9. A molten metal producing and refining method employing a furnace having large-diameter tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a gas mixture including oxygen and a second gas through said tuyeres and into said metal bath;

e) combusting said dissolved carbon and a first part of said oxygen in said gas mixture to produce heat and CO gas in said metal bath for heating and refining the metal containing material and leaving unburnt a second part of said oxygen;

f) performing a second combustion in said slag bath by combining said CO gas and said second part of said oxygen in said gas mixture and producing $CO_2$;

g) and adjusting the ratio $CO_2/(CO+CO_2)$ of the gas above said slag bath by controlling the ratio of the oxygen gas flow rate to the flow rate of said second gas and the metal bath level in the furnace, according to the relationship that when the ratio of oxygen gas flow rate to the flow rate of said second gas is reduced, the ratio $CO_2/(CO+CO_2)$ of the gas above said slag bath is increased, and reversely, when the ratio of oxygen gas flow rate to the flow rate of the second gas is increased, the ratio $CO_2/(CO+CO_2)$ is decreased, and according to the relationship that when the metal bath level in the furnace is lowered, the ratio $CO_2/(CO+CO_2)$ of the gas above said slag level is increased, and reversely, when the metal bath level in the furnace is raised, the ratio $CO_2/(CO+CO_2)$ is decreased.

10. A molten metal producing and refining method employing a furnace having tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a double layer of gas including an inner layer of oxygen having a large diameter and an outer layer of a second gas through said tuyeres and into said metal bath;

e) combusting said dissolved carbon and a first part of said oxygen in said double layer to produce heat and CO gas in said metal bath for heating and refining the metal containing material and leaving a second part of said oxygen unburnt;

f) performing a second combustion in said slag bath by combining said CO gas and said second part of said oxygen in said double layer and producing $CO_2$;

g) and adjusting the ratio $CO_2/(CO+CO_2)$ of the gas above said slag bath by controlling the ratio of the oxygen gas flow rate to the flow rate of said second gas and the metal bath level in the furnace, according to the relationship that when the ratio of the oxygen gas flow rate to the flow rate of said second gas is reduced, the ratio $CO_2/(CO+CO_2)$ of the gas above said slag bath is increased, and reversely, when the ratio of the oxygen gas flow rate to the flow rate of said second gas is increased, the ratio $CO_2/(CO+CO_2)$ is decreased, and the relationship that when the metal bath level in the furnace is lowered, the ratio $CO_2/(CO+CO_2)$ of the gas above said slag bath is increased, and reversely, when the metal bath level in the furnace is raised, the ratio $CO_2/(CO+CO_2)$ is decreased.

11. A molten metal producing and refining method employing a furnace having large-diameter tuyeres and small-diameter tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a mixture of gas including oxygen and a second kind of gas through said tuyeres and into said metal bath;

e) combusting said dissolved carbon and a first part of said oxygen in said mixture to produce heat and CO gas in said metal bath for heating and refining the metal containing material and leaving a second part of said oxygen unburnt;

f) performing a second combustion in said slag bath by combining said CO gas and the second part of said oxygen in said mixture and producing $CO_2$;

g) measuring the CO concentration and the $CO_2$ concentration above said slag bath in said furnace;

h) and adjusting the ratio $CO_2/(CO+CO_2)$ of the gas above said slag bath by controlling the oxygen gas flow rate and the gas flow rate of said second kind of gas and the metal bath level in the furnace, according to the relationship that when said metal bath level in said furnace is lowered, the ratio $CO_2/(CO+CO_2)$ of the gas above said slag bath is increased, and reversely, when the metal bath level in the furnace is raised, the ratio $CO_2/(CO+CO_2)$ is decreased.

12. A molten metal producing and refining method employing a furnace having large-diameter tuyeres near the bottom thereof and an internal pressure, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a mixture of gas including oxygen and a second kind of gas through said tuyeres and into said metal bath;

e) combusting said dissolved carbon and a first part of said oxygen in said mixture to produce heat and CO gas in said metal bath for heating and refining the metal containing material and leaving a second part of said oxygen unburnt;

f) performing a second combustion in said slag bath by combining said CO gas and the second part of said oxygen in said mixture and producing $CO_2$;

g) and adjusting the ratio $CO_2/(CO+CO_2)$ of the gas above said slag bath by controlling the ratio of the oxygen gas flow rate to the flow rate of said second kind of gas and the pressure in the furnace, according to the relationship that when the ratio of oxygen gas flow rate to the flow rate of the second kind of gas is reduced, the ratio $CO_2/(CO+CO_2)$ of the gas above said slag bath is increased, and reversely, when the ratio of the oxygen gas flow rate to the flow rate of the second kind of gas is increased, the ratio $CO_2/(CO+CO_2)$ of the gas is decreased, and the relationship that when the pressure in the furnace is reduced, the ratio $CO_2/(CO+CO_2)$ of the gas above said slag bath is increased, and reversely, when the pressure in the furnace is increased, the ratio $CO_2/(CO+CO_2)$ is decreased.

13. A molten metal producing and refining method employing a furnace having tuyeres near the bottom thereof and an internal pressure, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) introducing a double layer gas flow including a large diameter inner layer of oxygen and an outer layer of a second gas other than oxygen through said tuyeres and into said metal bath;

e) combusting said dissolved carbon and a first part of said oxygen in said inner layer to produce heat and CO gas in said metal bath for heating and refining the metal containing material and leaving a second part of said oxygen unburnt;

f) performing a second combustion in said slag bath by combining said CO gas and the second part of said oxygen in said inner layer and producing $CO_2$;

g) and adjusting the ratio $CO_2/(CO+CO_2)$ of the gas above said slag bath by controlling the ratio of the oxygen gas flow rate of said inner layer to the flow rate of the second gas and the pressure in the furnace, according to the relationship that when the ratio of oxygen gas flow rate to the flow rate of the second gas is reduced, the ratio $CO_2/(CO+CO_2)$ of the gas above said slag bath is increased, and reversely, when the ratio of the oxygen gas flow rate to the flow rate of the second gas is increased, the ratio $CO_2/(CO+CO_2)$ of the gas is decreased, and the relationship that when the pressure in the furnace is reduced, the ratio $CO_2/(CO+CO_2)$ of the gas above said slag bath is increased, and reversely, when the pressure in the furnace is increased, the ratio $CO_2/(CO+CO_2)$ is decreased.

14. A molten metal producing and refining method employing a furnace having a plurality of large-diameter and small-diameter tuyeres near the bottom thereof and an internal pressure, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a mixture of gas including oxygen and a second kind of gas through said tuyeres and into said metal bath;

e) combusting said dissolved carbon and a first part of said oxygen in said mixture to produce heat and CO gas in said metal bath for heating and refining the metal containing material and leaving a second part of said oxygen unburnt;

f) performing a second combustion in said slag bath by combining said CO gas and the second part of said oxygen in said mixture and producing $CO_2$;

g) measuring the CO concentration and the $CO_2$ concentration above said slag bath;

h) and adjusting the ratio $CO_2/(CO+CO_2)$ of the gas above said slag bath by controlling the oxygen gas flow rate and the gas flow rate of the second gas and the pressure in the furnace, according to the relationship that when said pressure in the furnace is reduced, the ratio $CO_2/(CO+CO_2)$ of the gas above said slag bath is increased, and reversely, when said pressure is increased, the ratio $CO_2/(CO+CO_2)$ of the gas is decreased.

15. A molten metal producing and refining method employing a furnace having an internal pressure and having a large-diameter tuyere near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a gas mixture including oxygen and a different kind of gas through said tuyeres and into said metal bath;

e) combusting said dissolved carbon and a first part of said oxygen in said gas mixture to produce heat and CO gas in said metal bath for heating and refining the metal containing material and leaving a second part of said oxygen unburnt;

f) performing a second combustion in said slag bath by combining said CO gas and said second part of said oxygen in said gas mixture and producing $CO_2$;

g) and adjusting the ratio $CO_2/(CO+CO_2)$ of the gas above said slag bath by controlling the ratio of the oxygen gas flow rate to the flow rate of the different kind of gas and the metal bath level in the furnace and the pressure in the furnace, according to the relationship that when the ratio of the oxygen gas flow rate in said mixture to the flow rate of the different kind of gas is reduced, the ratio $CO_2/(CO+CO_2)$ of the gas above said slag bath is increased, and reversely, when the ratio of the oxygen gas flow rate to the flow rate of the different kind of gas is increased, the ratio $CO_2/(CO+CO_2)$ is decreased, and the relationship that when the metal bath level in the furnace is lowered, the ratio $CO_2/(CO+CO_2)$ of the gas above said slag bath is increased, and reversely, when the metal bath level in the furnace is raised, the ratio $CO_2/(CO+CO_2)$ is decreased, and the relationship that when said pressure in the furnace is reduced, the ratio $CO_2/(CO+CO_2)$ of the gas above said slag bath is increased, and reversely, when said pressure in the furnace is increased, the ratio $CO_2/(CO+CO_2)$ of the gas is decreased.

16. A molten metal producing and refining method employing a furnace having an internal pressure and having tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a double layer of gas including an inner large diameter layer of oxygen and an outer layer of a different gas other than oxygen, the outer layer surrounding the inner layer, through said tuyeres and into said metal bath;

e) combusting said dissolved carbon and a first part of said oxygen in said double layer to produce heat and CO gas in said metal bath for heating and refining the metal containing material and leaving a second part unburnt;

f) performing a second combustion in said slag bath by combining said CO gas and said second part of said oxygen in said double layer and producing $CO_2$;

g) and adjusting the ratio $CO_2/(CO+CO_2)$ of the gas above said slag bath by controlling the ratio of the oxygen gas flow rate in said double layer of gas to the flow rate of said different gas, and the metal bath level in the furnace and the pressure in the furnace, according to the relationship that when the ratio of oxygen gas flow rate to the flow rate of the different gas is reduced, the ratio $CO_2/(CO+CO_2)$ of the gas above said slag bath is increased, and reversely, when the ratio of the oxygen gas flow rate to the flow rate of said different gas is increased, the ratio $CO_2/(CO+CO_2)$ is decreased, the relationship that when the metal bath level in the furnace is lowered, the ratio $CO_2/(CO+CO_2)$ of the gas above said slag bath is increased, and reversely, when the metal bath level in the furnace is raised, the ratio $CO_2/(CO+CO_2)$ is decreased, and the relationship that when the pressure in the furnace is reduced, the ratio $CO_2/(CO+CO_2)$ of the gas above said slag bath is increased, and reversely, when the pressure in the furnace is increased, the ratio $CO_2/(CO+CO_2)$ is decreased.

17. A molten metal producing and refining method employing a furnace having an internal pressure and having large-diameter and small-diameter tuyeres near the bottom thereof, comprising the steps of:

a) introducing into said furnace a metal containing material, a carbonaceous material and a flux;

b) heating said metal containing material to produce a metal bath adjacent the bottom of said furnace and a slag bath on top of said metal bath;

c) dissolving in said metal bath carbon contained in said carbonaceous material;

d) blowing a gas mixture of gas including oxygen and a different kind of gas through said tuyeres and into said metal bath;

e) combusting said dissolved carbon and a first part of said oxygen in said gas mixture to produce heat and CO gas in said metal bath for heating and melting and refining the metal containing material and leaving a second part unburnt;

f) performing a second combustion in said slag bath by combining said CO gas and said second part of said oxygen in said gas mixture and producing $CO_2$;

g) measuring the CO concentration and the $CO_2$ concentration in the gas above said slag bath;

h) and adjusting the ratio $CO_2/(CO+CO_2)$ of the gas above said slag bath by controlling the oxygen gas flow rate and the gas flow rate of said different kind of gas, the metal bath level in the furnace, and the pressure in the furnace, according to the relationship that when the metal bath level in the furnace is lowered, the ratio $CO_2/(CO+CO_2)$ of the gas above said slag bath is increased, and reversely, when the metal bath level in the furnace is raised, the ratio $CO_2/(CO+CO_2)$ of the gas is decreased, and the relationship that when the pressure in the furnace is reduced, the ratio $CO_2/(CO+CO_2)$ of the gas above said slag bath is increased, and reversely, when the pressure in the furnace is increased, the ratio $CO_2/(CO+CO_2)$ of the gas is decreased.

* * * * *